US011450288B2

(12) United States Patent
Yang et al.

(10) Patent No.: US 11,450,288 B2
(45) Date of Patent: Sep. 20, 2022

(54) DISPLAY DRIVING METHOD, DISPLAY DRIVING CIRCUIT, AND DISPLAY DEVICE

(71) Applicants: Beijing BOE Display Technology Co., Ltd., Beijing (CN); BOE TECHNOLOGY GROUP CO., LTD., Beijing (CN)

(72) Inventors: Yan Yang, Beijing (CN); Chinghua Hung, Beijing (CN); Rui Liu, Beijing (CN); Wei Sun, Beijing (CN); Ming Chen, Beijing (CN); Wenchieh Huang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 96 days.

(21) Appl. No.: 16/963,302

(22) PCT Filed: Sep. 23, 2019

(86) PCT No.: PCT/CN2019/107272
§ 371 (c)(1),
(2) Date: Jul. 20, 2020

(87) PCT Pub. No.: WO2021/056141
PCT Pub. Date: Apr. 1, 2021

(65) Prior Publication Data
US 2021/0407442 A1 Dec. 30, 2021

(51) Int. Cl.
*G09G 3/36* (2006.01)

(52) U.S. Cl.
CPC ..... *G09G 3/36* (2013.01); *G09G 2310/0275* (2013.01); *G09G 2310/08* (2013.01)

(58) Field of Classification Search
None
See application file for complete search history.

(56) References Cited

U.S. PATENT DOCUMENTS 8,791,893 B2 7/2014 Liao et al.
9,240,154 B2 1/2016 Park et al.
(Continued)

FOREIGN PATENT DOCUMENTS

CN 102402957 A 4/2012
CN 102456331 A 5/2012
(Continued)

OTHER PUBLICATIONS

Written Opinion for International Application No. PCT/CN2019/107272 dated Jun. 28, 2020.

*Primary Examiner* — Christopher J Kohlman
(74) *Attorney, Agent, or Firm* — Xsensus LLP

(57) ABSTRACT

A display driving method includes: controlling a source driver to output a data signal, wherein the data signal comprises a plurality of first active pulse signals, the first active pulse signal in the Nth row is for driving a sub-pixel unit in the Nth row, and a timing difference between a starting point of the first active pulse signal in the Nth row and a starting point of a corresponding gate drive signal is smaller than a timing difference between a starting point of the first active pulse signal in the (N+M)th row and a starting point of a corresponding gate drive signal; and wherein the sub-pixel unit in the Nth row is closer to the source driver than the sub-pixel unit in the (N+M)th row, and N and M are positive integers greater than or equal to 1.

14 Claims, 5 Drawing Sheets

(56) References Cited

U.S. PATENT DOCUMENTS

| | | | | |
|---|---|---|---|---|
| 2012/0098813 | A1 | 4/2012 | Park et al. | |
| 2013/0120344 | A1 | 5/2013 | Liao et al. | |
| 2017/0221443 | A1* | 8/2017 | Koh | G09G 3/3696 |
| 2018/0090094 | A1 | 3/2018 | Jung | |
| 2018/0374447 | A1 | 12/2018 | Yun | |
| 2019/0295488 | A1 | 9/2019 | Guo | |

FOREIGN PATENT DOCUMENTS

| | | | |
|---|---|---|---|
| CN | 102768817 | A | 11/2012 |
| CN | 103198803 | A | 7/2013 |
| CN | 105629539 | A | 6/2016 |
| CN | 103198803 | B | 8/2016 |
| CN | 106200057 | A | 12/2016 |
| CN | 106297712 | A | 1/2017 |
| CN | 107170418 | A | 9/2017 |
| CN | 109473075 | A | 3/2019 |
| EP | 3519884 | A1 | 8/2019 |
| KR | 20050031645 | A | 4/2005 |
| KR | 20090061458 | A | 6/2009 |
| KR | 100984358 | B1 | 9/2010 |
| KR | 101491137 | B1 | 2/2015 |
| WO | 2014153822 | A1 | 10/2014 |
| WO | 2018059102 | A1 | 4/2018 |

* cited by examiner

DISPLAY DRIVING METHOD, DISPLAY DRIVING CIRCUIT, AND DISPLAY DEVICE

CROSS-REFERENCE TO RELATED APPLICATION

This application is a national phase application under 35 U.S.C. § 3 71 of International Patent Application No. PCT/CN2019/107272, filed on Sep. 23, 2019, the contents of which being incorporated by reference in their entirety herein.

TECHNICAL FIELD

The present disclosure relates to the field of display technology and, more particularly, to a display driving method, a display driving circuit, and a display device.

BACKGROUND

When the frame rate of a display panel becomes higher and higher, the time of a single frame becomes shorter and shorter. As such, a charging time assigned to each sub-pixel unit of a display device becomes shorter and shorter. In order to achieve a better charging effect, it is becoming increasingly important to reasonably assign the charging time of each sub-pixel unit to achieve a better charging effect.

SUMMARY

The purpose of the present disclosure is to provide a display driving method, a display driving circuit, and a display device, which are capable of improving the problem of insufficient data charging time of a far-end sub-pixel.

According to a first aspect of the present disclosure, there is provided a display driving method, including:

controlling a source driver to output a data signal, wherein the data signal comprises a plurality of first active pulse signals, the first active pulse signal in the Nth row is for driving a sub-pixel unit in the Nth row, and a timing difference between a starting point of the first active pulse signal in the Nth row and a starting point of a corresponding gate drive signal is smaller than a timing difference between a starting point of the first active pulse signal in the (N+M)th row and a starting point of a corresponding gate drive signal; and wherein the sub-pixel unit in the Nth row is closer to the source driver than the sub-pixel unit in the (N+M)th row, and N and M are positive integers greater than or equal to 1.

In an exemplary embodiment of the disclosure, the controlling the source driver to output the data signal comprises:

outputting a data output control signal to the source driver by using a timing controller; and controlling the source driver to output the data signal based on the data output control signal;

wherein the data output control signal comprises a plurality of second active pulse signals, and each of the first active pulse signals corresponds to one second active pulse signal.

In an exemplary embodiment of the disclosure, the controlling the source driver to output the data signal comprises:

outputting a control signal to the source driver by using a timing controller;

controlling the source driver to generate a data output control signal according to the control signal; and controlling the source driver to output the data signal based on the data output control signal;

wherein the data output control signal comprises a plurality of second active pulse signals, and each of the first active pulse signals corresponds to one second active pulse signal.

In an exemplary embodiment of the disclosure, the first active pulse signal is started to be output at a starting point of the second active pulse signal, and wherein a timing difference between a starting point of the second active pulse signal in the Nth row and the starting point of the corresponding gate drive signal is smaller than a timing difference between a starting point of the second active pulse signal in the (N+M)th row and the starting point of the corresponding gate drive signal.

In an exemplary embodiment of the disclosure, the first active pulse signal is started to be output at an end point of the second active pulse signal, and wherein a timing difference between an end point of the second active pulse signal in the Nth row and the starting point of the corresponding gate drive signal is smaller than a timing difference between an end point of the second active pulse signal in the (N+M)th row and the starting point of the corresponding gate drive signal.

In an exemplary embodiment of the disclosure, M is larger than 1, where the timing difference between the starting point of the first active pulse signal in each of the Nth row, the (N+1)th row, . . . , and the (N+M−1)th row and the starting point of the corresponding gate drive signal is equal.

In an exemplary embodiment of the disclosure, the timing difference is 0 to 0.5 μs.

In an exemplary embodiment of the disclosure, the timing difference between an end point of the first active pulse signal of each row and an end point of the corresponding gate drive signal is greater than or equal to zero.

According to a second aspect of the present disclosure, there is provided a display driving circuit, comprising:

a controller and a source driver communicatively connected to the controller, wherein the controller is for controlling the source driver to output a data signal, wherein the data signal comprises a plurality of first active pulse signals, the first active pulse signal in the Nth row is for driving a sub-pixel unit in the Nth row, and a timing difference between a starting point of the first active pulse signal in the Nth row and a starting point of a corresponding gate drive signal is smaller than a timing difference between a starting point of the first active pulse signal in the (N+M)th row and a starting point of a corresponding gate drive signal, and wherein the sub-pixel unit in the Nth row is closer to the source driver than the sub-pixel unit in the (N+M)th row, and N and M are positive integers greater than or equal to 1.

In an exemplary embodiment of the disclosure, the controller is a timing controller, which is for outputting a data output control signal to the source driver, and the source driver is controlled to output the data signal based on the data output control signal; and wherein the data output control signal comprises a plurality of second active pulse signals, and each of the first active pulse signals corresponds to one second active pulse signal.

In an exemplary embodiment of the disclosure, the controller is a timing controller, which is for outputting a control signal to the source driver; the source driver is controlled to generate a data output control signal according to the control signal; and the source driver is controlled to output the data signal based on the data output control signal; and wherein the data output control signal comprises a plurality of second active pulse signals, and each of the first active pulse signals corresponds to one second active pulse signal.

In an exemplary embodiment of the disclosure, the first active pulse signal is started to be output at a starting point of the second active pulse signal, and wherein a timing difference between a starting point of the second active pulse signal in the Nth row and the starting point of the corresponding gate drive signal is smaller than a timing difference between a starting point of the second active pulse signal in the (N+M)th row and the starting point of the corresponding gate drive signal.

In an exemplary embodiment of the disclosure, wherein the first active pulse signal is started to be output at an end point of the second active pulse signal, and wherein a timing difference between an end point of the second active pulse signal in the Nth row and the starting point of the corresponding gate drive signal is smaller than a timing difference between an end point of the second active pulse signal in the (N+M)th row and the starting point of the corresponding gate drive signal.

According to a third aspect of the present disclosure, there is provided a display device, comprising: a display panel and the display driving circuit according to any one of the above items, wherein the display driving circuit is used to drive the display panel.

The technical solutions provided by the disclosure may achieve the following beneficial effects:

The display driving method, the display driving circuit, and the display device provided by the disclosure include: controlling the source driver to output the data signal, wherein the data signal comprises the plurality of first active pulse signals, the first active pulse signal in the Nth row is for driving a sub-pixel unit in the Nth row, and the timing difference between the starting point of the first active pulse signal in the Nth row and the starting point of the corresponding gate drive signal is smaller than the timing difference between the starting point of the first active pulse signal in the (N+M)th row and the starting point of the corresponding gate drive signal; and wherein the sub-pixel unit in the Nth row is farther away from the source driver than the sub-pixel unit in the (N+M)th row, and N and M are positive integers greater than or equal to 1. Such a design may compensate for the problem of poor data charging of the far-end sub-pixel unit due to the data delay caused by the voltage drop, that is, the data charging time of the far-end sub-pixel unit may be increased.

It is to be understood that both the foregoing general description and the following detailed description are exemplary and explanatory only and are not restrictive of the present disclosure.

BRIEF DESCRIPTION OF THE DRAWINGS

The drawings herein, which are incorporated in and constitute a part of this specification, illustrate embodiments consistent with the present disclosure, and serve to explain the principles of the present disclosure together with the description. Understandably, the drawings in the following description are just some embodiments of the present disclosure. For those of ordinary skill in the art, other drawings may be obtained based on these drawings without creative efforts.

DETAILED DESCRIPTION

Figure 1:
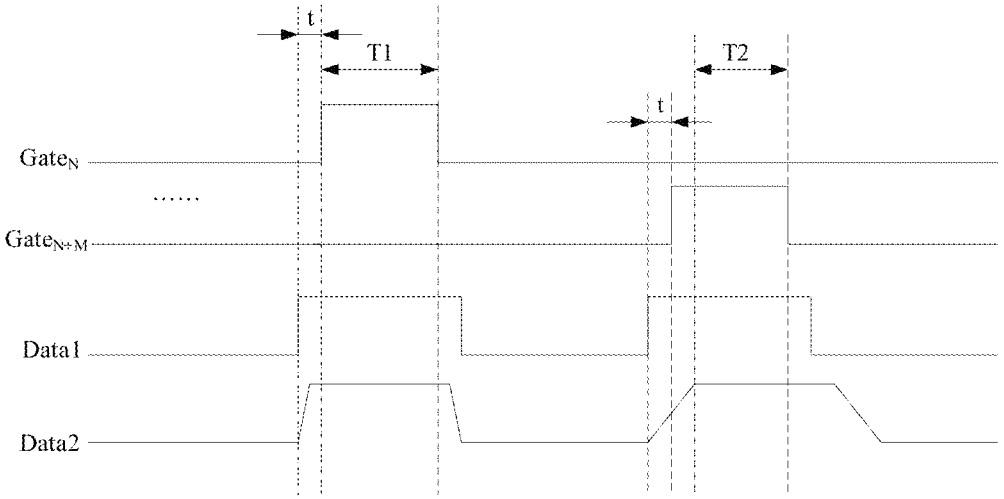
FIG. 1 shows a timing relationship diagram of signals in a display driving method in the prior art.

Example embodiments will now be described more fully with reference to the accompanying drawings. However, the example embodiments can be implemented in various forms and should not be construed as limited to the embodiments set forth herein; rather, these embodiments are provided so that the disclosure will be thorough and complete, and will fully convey the concept of the example embodiments to those skilled in the art. The same reference numerals in the drawings denote the same or similar structures, and thus their detailed descriptions will be omitted.

Although relative terms such as "up" and "down" are used in this specification to describe the relative relationship between one component illustrated in the drawings and another component, these terms are used in this specification for convenience only, for example, according to the illustrative direction depicted in the drawings. It can be understood that if the device illustrated in the drawings is inversed and turned upside down, the component described "above" would become the component "below". When a structure is "on" other structure(s), it may mean that the structure is integrally formed on the other structure(s), or that the structure is "directly" arranged on the other structure(s), or that the structure is "indirectly" arranged on other structure(s) through another structure.

As users have higher and higher requirements for display products, display products with high penetration rate, high resolution, and high frame rate have received more attention, but the resulting problem of insufficient charging rate urgently needs to be resolved. An end closer to a source driver (that is, a near-end sub-pixel unit) has sufficient charging time, while an end farther away from the source driver (that is, a far-end sub-pixel unit) causes data delay due to voltage drop, so the problem of insufficient charging time may occur, that is, the charging rate gradually decreases from the near end to the far end of the source driver.

Specifically, as shown in FIG. 1, a data signal (that is, a theoretical data signal) Data1 output by the source driver includes a plurality of data pulse signals. The data pulse signal in the Nth row is used to drive the sub-pixel unit in the Nth row (that is, the near-end sub-pixel unit), and the data pulse signal in the (N+M)th row is used to drive the sub-pixel unit in the (N+M)th row (that is, the far-end sub-pixel unit). A timing difference between a starting point of the data pulse signal in the Nth row and a starting point of the gate drive signal $Gate_N$ in the Nth row is the same as a timing difference between a starting point of the data pulse signal in the (N+M)th row and a starting point of the gate drive signal $Gate_{N+M}$ in the (N+M)th row, both equal to t. It should be understood that the gate drive signal $Gate_N$ (or $Gate_{N+M}$) in the Nth row (or the (N+M)th row) is used to drive a thin film transistor (TFT) of the sub-pixel unit in the Nth row (or the (N+M)th row) to turn on, so that sub-pixel unit in the Nth row (or the (N+M)th row) receives the data pulse signal in the Nth row (or the (N+M)th row).

However, due to the voltage drop, the data signal actually received by the sub-pixel unit in one column is Data2. As shown in FIG. 1, a rising edge of the data pulse signal received by the sub-pixel unit in the (N+M)th row is much wider than a rising edge of the data pulse signal received by the sub-pixel unit in the Nth row. Therefore, the data delay of the sub-pixel unit in the (N+M)th row is more serious than that of the sub-pixel unit in the Nth row, so that a charging duration T2 of the sub-pixel unit in the (N+M)th row is shorter than a charging duration T1 of sub-pixel unit in the Nth row.

Figure 2:
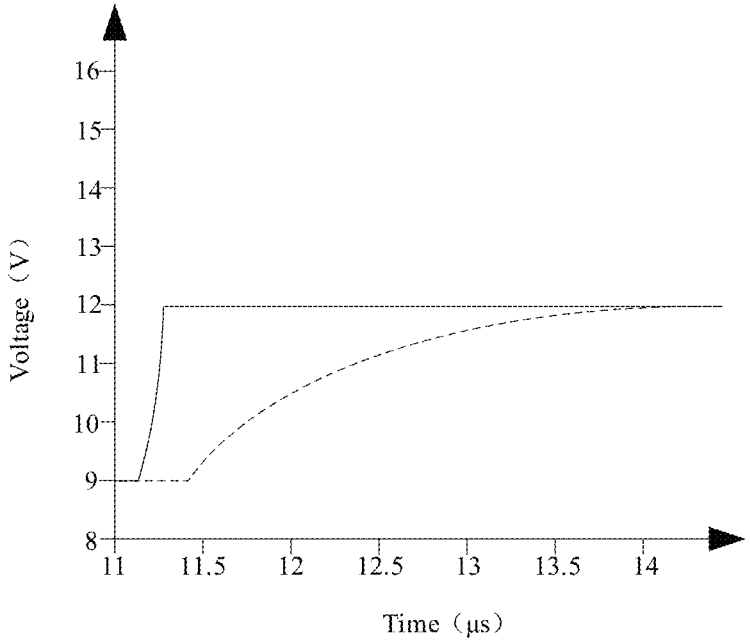
FIG. 2 shows a simulation result diagram of data rising time of the farthest end sub-pixel unit and near-end sub-pixel unit in the prior art.
Figure 3:
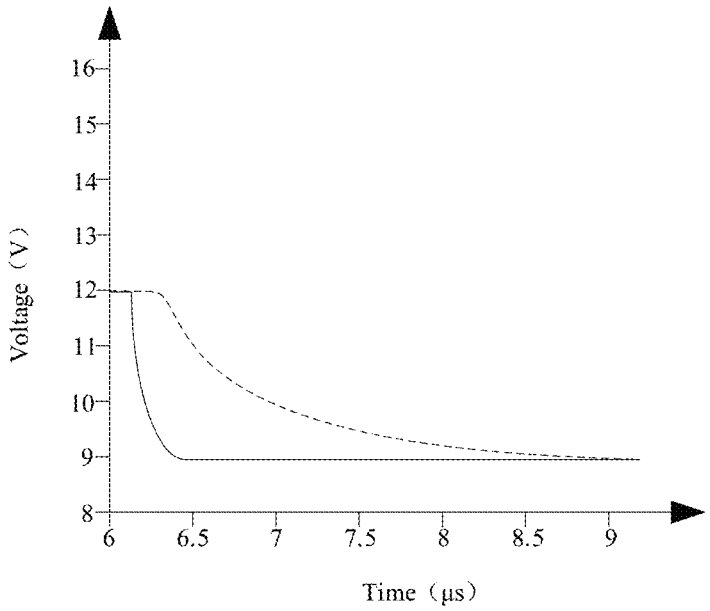
FIG. 3 shows a simulation result diagram of data falling time of the farthest end sub-pixel unit and near-end sub-pixel unit in the prior art.

For example, FIG. 2 shows a simulation result diagram of data rising time of the farthest end sub-pixel unit (that is, the sub-pixel unit farthest from the source driver) and near-end sub-pixel unit (that is, the sub-pixel unit closer to the source driver than the farthest end sub-pixel unit), and FIG. 3 shows a simulation result diagram of data falling time of the farthest end sub-pixel unit and near-end sub-pixel unit. The dotted line in FIG. 2 may be the data rising time of the farthest end sub-pixel unit, and the solid line may be the data rising time of the near-end sub-pixel unit. Further, the dotted line in FIG. 3 is the data falling time of the farthest end sub-pixel unit, and the solid line is the data falling time of the near-end sub-pixel unit.

According to the simulation data in FIGS. 2 and 3, it can be seen that the position where the data of the farthest end sub-pixel unit start to rise or decline is more delayed than the position where the data of the near-end sub-pixel unit start to rise or decline. As shown in the simulation results in FIGS. 2 and 3, the data delay time of the farthest end sub-pixel unit is about 0.4 μs, but it is not limited thereto, and the specific value needs to be determined according to the property of a display panel.

Based on the foregoing, it can be seen that the data delay of the far-end sub-pixel unit is more serious than that of the near-end sub-pixel unit, therefore, when the thin film transistors (TFT) of the sub-pixel units are turned on line by line, the charging duration of the far-end sub-pixel unit is shorter than the charging duration of the near-end sub-pixel unit. As a result, the charging rate of the far-end sub-pixel unit is smaller than that of the near-end sub-pixel unit.

Figure 4:
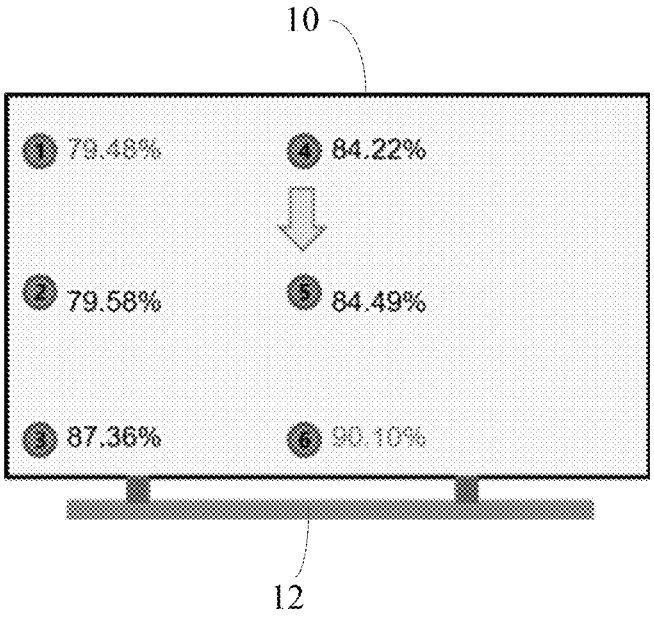
FIG. 4 shows a simulation result diagram of a charging rate at various positions of a display panel in a display device in the prior art.

Specifically, in FIG. 4, the display panel 10 is divided into two columns, where the No. 1 position, No. 2 position and No. 3 position are in one column, and the corresponding charging rate is from 87.36%→79.85%→79.48% from No. 3 position→No. 2 position→No. 1 position; and No. 4 position, No. 5 position and No. 6 position are in one column, and the corresponding charging rate is from 90.10%→84.49%→84.22% from No. 6 position→No. 5 position→No. 4 position. That is, from the near end to the far end of the source driver 12, the charging rate gradually decreases.

It should be understood that the present embodiment is merely intended to indicate that the charging rate gradually decreases from the near end to the far end of the source driver, but the value of the charging rate is not limited thereto, and the specific value needs to be determined according to the property of the display panel.

In addition, it should be noted that the charging rate of the sub-pixel unit is affected not only by its positional relationship with the source driver, but also by other influences, such as its positional relationship with the gate driver. Therefore, although the distances from the No. 3 position and the No. 6 position to the source driver in FIG. 4 are substantially the same, the charging rate is still different.

Figure 5:
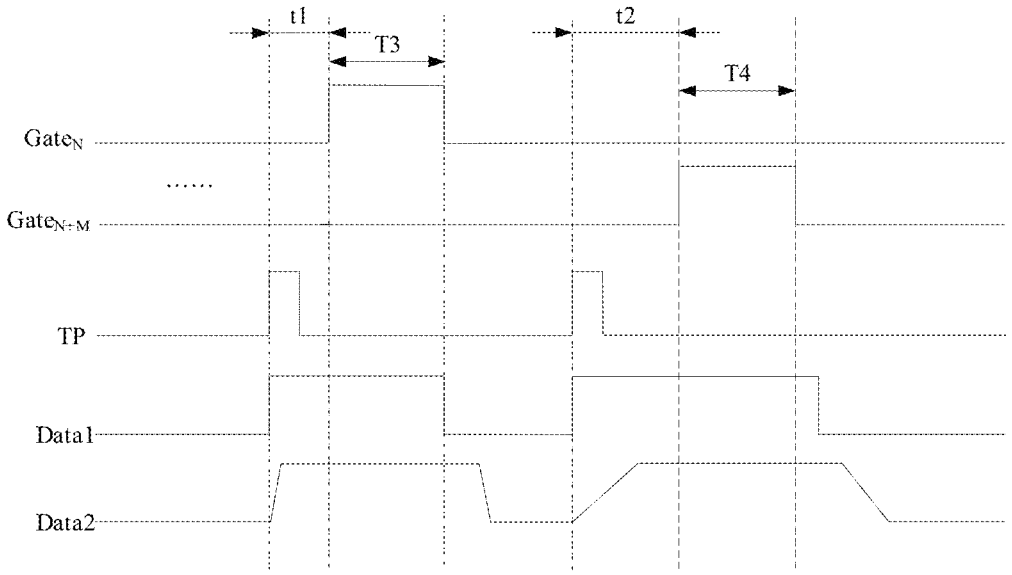
FIG. 5 shows a timing relationship diagram of signals in a display driving method according to an embodiment of the present disclosure.
Figure 6:
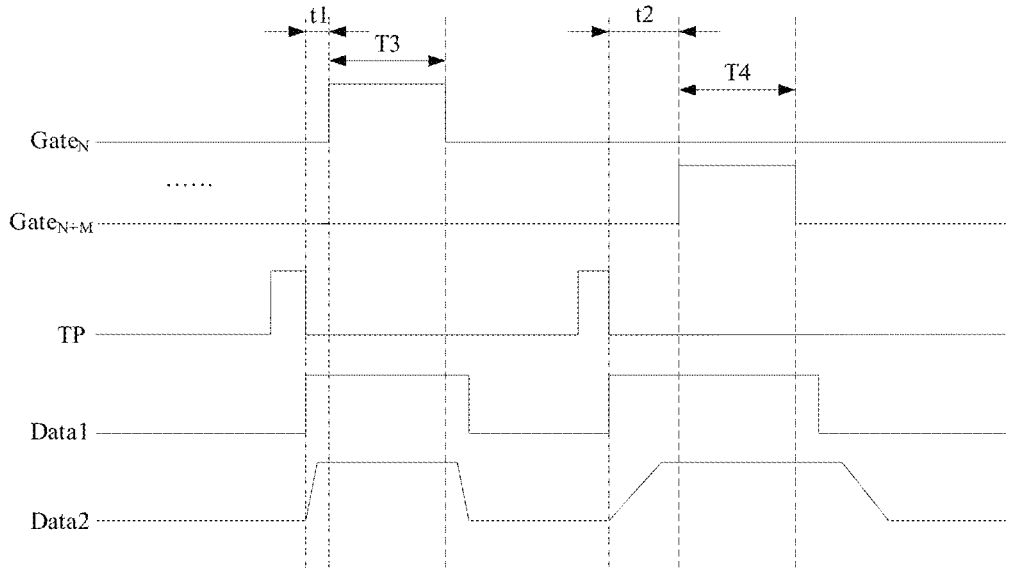
FIG. 6 shows a timing relationship diagram of signals in a display driving method according to another embodiment of the present disclosure.

In order to solve the above-mentioned problems, an embodiment of the present disclosure provides a display driving method for driving a display panel to display. The display driving method includes:

controlling a source driver to output a data signal, wherein the data signal Data1 output by the source driver may include a plurality of first active pulse signals (that is, data pulse signals), the first active pulse signal in the Nth row is for driving a sub-pixel unit in the Nth row, and a timing difference t1 between a starting point of the first active pulse signal in the Nth row and a starting point of a corresponding gate drive signal $Gate_N$ is smaller than a timing difference t2 between a starting point of the first active pulse signal in the (N+M)th row and a starting point of a corresponding gate drive signal $Gate_{N+M}$, as shown in FIGS. 5 and 6.

The sub-pixel unit in the Nth row is closer to the source driver than the sub-pixel unit in the (N+M)th row, and N and M are positive integers greater than or equal to 1. It should be understood that the sub-pixel unit in the Nth row may be the above-mentioned near-end sub-pixel unit, and at this time, the first active pulse signal in the Nth row may be defined as the near-end first active pulse signal; and the sub-pixel unit in the (N+M)th row may be the above-mentioned far-end sub-pixel unit, and at this time, the first active pulse signal in the (N+M)th row may be defined as the far-end first active pulse signal.

In the embodiment, the timing difference t2 between the starting point of the first active pulse signal in the far-end sub-pixel unit (that is, the sub-pixel unit in the (N+M)th row) and the starting point of the corresponding gate drive signal $Gate_{N+M}$ is greater than the timing difference t1 between the starting point of the first active pulse signal in the near-end sub-pixel unit (that is, the sub-pixel unit in the Nth row) and the starting point of the corresponding gate drive signal $Gate_N$, such that the far-end sub-pixel unit enters a data charging stage earlier than the near-end sub-pixel unit, thereby compensating for the problem of poor data charging of the far-end sub-pixel unit due to the data delay caused by the voltage drop. That is, the data charging time of the far-end sub-pixel unit may be increased, so that the data charging time of the far-end sub-pixel unit is not much different from the data charging time of the near-end sub-pixel unit. For example, in FIG. 5, the data charging time T4 of the sub-pixel unit in the (N+M)th row is equal to the data charging time T3 of the sub-pixel unit in the Nth row, thereby improving the display effect.

It should be understood that when the gate drive signal is active at a high level, the starting point of the gate drive signal is at its rising edge, and the end point is at its falling edge; and when the gate drive signal is active at a low level, the starting point of the gate drive signal is at its falling edge, and the end point is at its rising edge. Similarly, when the first active pulse signal is active at a high level, the starting point of the first active pulse signal is at its rising edge, and the end point is at its falling edge; and when the first active pulse signal is active at a low level, the starting point of first active pulse signal is at its falling edge, and the end point is at its rising edge.

As shown in FIGS. 5 and 6, in the embodiment, since the transmission of the data signal Data1 is related to a data output control signal TP, that is, the output position of the data signal Data1 is related to the position of the data output control signal TP, the data signal Data1 output by the source driver may be controlled by the data output control signal TP, that is, the output position of the data signal Data1 is changed by changing the position of the data output control signal TP, so that the total time of one frame is not changed, and only the position of the near-end first active pulse signal is transferred.

In the embodiment, the controlling the source driver to output the data signal is achieved by the data output control signal TP. Specifically, the following two solutions may be included.

The first solution: the controlling the source driver to output the data signal may include:

Step S100, outputting a data output control signal TP to the source driver by using a timing controller; and Step S102, controlling the source driver to output the data signal Data1 based on the data output control signal TP.

It should be understood that, in this solution, the data output control signal TP ultimately used to control the source driver to output the above data signal Data1 is generated internally by the timing controller, and the timing controller transmits the data output control signal TP generated internally to the source driver. The source driver generates the corresponding data signal Data1 based on the data output control signal TP, and outputs the data signal Data1.

The second solution: the controlling the source driver to output the data signal may include:

Step S200, outputting a control signal to the source driver by using a timing controller;

Step S202, controlling the source driver to generate a data output control signal TP according to the control signal; and Step S204, controlling the source driver to output the data signal Data1 based on the data output control signal TP.

It should be understood that the control signal output by the timing controller to the source driver may be an initial data output control signal, and the initial data output control signal may be transmitted to a component of the source driver. The component may modify the initial data output control signal to generate the final data output control signal TP, and may send the finally generated data output control signal TP to another component of the source driver, which can generate the corresponding data signal Data1 through the final data output control signal TP, and outputs the data signal Data1.

The data output control signal TP in any of the foregoing solutions includes a plurality of second active pulse signals (that is, active TP pulse signals), and each of the first active pulse signals corresponds to one second active pulse signal.

Optionally, as shown in FIGS. 5 and 6, the second active pulse signal may be a high level active signal. When the second active pulse signal is the high level active signal, a starting point of the second active pulse signal is at its rising edge, and an end point of the second active pulse signal is at its falling edge. But it is not limited thereto, the second active pulse signal may also be a low level active signal. When the second active pulse signal is the low level active signal, the starting point of the second active pulse signal is at its falling edge, and the end point of the second active pulse signal is at its rising edge.

For example, the relationship between the transition of the data signal Data1 and the data output control signal TP may specifically the following two situations.

The first situation: the first active pulse signal is started to be output at the starting point of the second active pulse signal, applied to a display product with high frame rate.

When the first active pulse signal is started to be output at the starting point of the second active pulse signal, as shown in FIG. 5, a timing difference t1 between a starting point of the second active pulse signal in the Nth row and the starting point of the corresponding gate drive signal $Gate_N$ should be smaller than a timing difference t2 between a starting point of the second active pulse signal in the (N+M)th row and the starting point of the corresponding gate drive signal $Gate_{N+M}$, which may ensure that the timing difference t1 between the starting point of the first active pulse signal in the Nth row and the starting point of the corresponding gate drive signal $Gate_N$ is smaller than the timing difference t2 between the starting point of the first active pulse signal in the (N+M)th row and the starting point of the corresponding gate drive signal $Gate_{N+M}$.

The second situation: the first active pulse signal is started to be output at the end point of the second active pulse signal.

When the first active pulse signal is started to be output at the end point of the second active pulse signal, as shown in FIG. 6, a timing difference t1 between an end point of the second active pulse signal in the Nth row and the starting point of the corresponding gate drive signal $Gate_N$ should be smaller than a timing difference t2 between an end point of the second active pulse signal in the (N+M)th row and the starting point of the corresponding gate drive signal $Gate_{N+M}$, which may ensure that the timing difference t1 between the starting point of the first active pulse signal in the Nth row and the starting point of the corresponding gate drive signal $Gate_N$ is smaller than the timing difference t2 between the starting point of the first active pulse signal in the (N+M)th row and the starting point of the corresponding gate drive signal $Gate_{N+M}$.

Based on the foregoing two situations, it can be seen that the data output control signal TP may be used as a trigger signal of the data signal Data1, that is, the data output control signal TP may be used to control the output of the data signal Data1. Whether the first active pulse signal is output at the starting point of the second active pulse signal or at the end point of the second active pulse signal may be determined according to actual conditions.

In an embodiment, M may be equal to 1, so that from the near end to the far end of the source driver, the timing difference between the starting point of the first active pulse signal and the starting point of the corresponding gate drive signal increases line by line. That is, the timing difference between the starting point of the first active pulse signal and the starting point of the corresponding gate drive signal of the previous row (the row close to the source driver) of the two adjacent rows is smaller than the timing difference between the starting point of the first active pulse signal and the starting point of the corresponding gate drive signal of the next row (the row away from the source driver); and such a design may improve the charging effect of each row of sub-pixel units, thereby improving the display effect.

It should be understood that, as described above, the first active pulse signal is started to be output at the starting point (or the end point) of the second active pulse signal, therefore, when M is equal to 1, the timing difference between the starting point (or the end point) of the second active pulse signal and the starting point of the corresponding gate drive signal increases line by line.

In another embodiment, M may be larger than 1, where the timing difference between the starting point of the first active pulse signal in each of the Nth row, the (N+1)th row, . . . , and the (N+M−1)th row and the starting point of the corresponding gate drive signal is equal. That is to say, in the embodiment, a plurality of rows (that is, M rows) can be adjusted as a group, so as to compensate for the problem of poor data charging of the far-end sub-pixel unit due to the data delay caused by the voltage drop, and at the same time reduce the difficulty of adjustment.

Specifically, the display panel may include a plurality of groups of sub-pixel units, and each group of sub-pixel units is composed of M rows of sub-pixel units, wherein the timing difference between the starting point of the first active pulse signal of each row in each group of sub-pixel units and the starting point of the corresponding gate drive signal is equal. The timing difference between the starting point of the first active pulse signal and the starting point of the corresponding gate drive signal of the previous group (the group close to the source driver) of the two adjacent groups is smaller than the timing difference between the starting point of the first active pulse signal and the starting point of the corresponding gate drive signal of the next group (the group away from the source driver).

For example, when M is equal to 15 (that is, each group of sub-pixel units is composed of 15 rows of sub-pixel units), the timing difference between the starting point of the first active pulse signal of each of the first row, the second row, . . . , and the 15th row and the starting point of the corresponding gate drive signal is equal; the timing difference between the starting point of the first active pulse signal of the each of the 16th row, the 17th row, . . . , and the 30th row and the starting point of the corresponding gate drive signal is equal; and the timing difference between the starting point of the first active pulse signal of the 16th row and the starting point of the corresponding gate drive signal is larger than the timing difference between the starting point of the first active pulse signal of the 15th row and the starting point of the corresponding gate drive signal.

Optionally, M may be 15 to 1000, but it is not limited thereto, and the specific value may be determined according to the property of the display panel.

It should be understood that, as described above, the first active pulse signal is started to be output at the starting point (or the end point) of the second active pulse signal, therefore, when M is larger than 1 (that is, M rows are adjusted as a group), the timing difference between the starting point (or the end point) of the second active pulse signal of each row in each group of the sub-pixel units and the starting point of the corresponding gate drive signal is equal, and the timing difference between the starting point (or the end point) of the second active pulse signal and the starting point of the corresponding gate drive signal of the previous group (the group close to the source driver) of the two adjacent groups of the sub-pixel units is smaller than the timing difference between the starting point (or the end point) of the second active pulse signal and the starting point of the corresponding gate drive signal of the next group (the group away from the source driver).

In any of the aforementioned embodiments, the timing difference between the starting point of the first active pulse signal and the starting point of the corresponding gate drive signal may be 0 to 0.5 μs. Optionally, according to the simulation results shown in FIGS. 2 and 3, the data delay time of the farthest end sub-pixel unit is about 0.4 μs. Thus, in order to compensate for the problem of poor data charging of the farthest end sub-pixel unit caused by the data delay, the time for the farthest end sub-pixel unit to enter the data charging stage may be advanced by about 0.4 μs, but it is not limited thereto, and the specific value needs to be determined according to the property of the display panel.

It should be understood that, in order to ensure the data charging yield of the entire display panel, the starting point of the first active pulse signal of each row is generally earlier than the starting point of the corresponding gate drive signal. That is to say, under normal circumstances, the timing difference between the starting point of the first active pulse signal of each row and starting point of the corresponding gate drive signal is greater than 0. Therefore, in order to improve the charging effect of the farthest end sub-pixel unit, the timing difference between the starting point of the first active pulse signal of the farthest end sub-pixel unit and starting point of the corresponding gate drive signal should be greater than 0.4 μs.

In addition, it should also be understood that the charging duration of the sub-pixel unit is related to an active duration of the gate drive signal (the active duration is the time difference between the end point and the starting point of the gate drive signal), specifically, starting to charge the sub-pixel unit at the starting point of the gate driving signal, and finishing the charging at the end point of the gate driving signal. Thus, in order to further ensure the charging duration of each sub-pixel unit, it should be guaranteed that the timing difference between the end point of the first active pulse signal of each row and the end point of the corresponding gate drive signal is greater than or equal to zero.

The active duration of the first active pulse signal for driving each sub-pixel unit (the active duration is the time difference between the end point and the starting point of the first active pulse signal) may be the same, but it is not limited thereto. Alternatively, the active duration of the far-end first active pulse signal (that is, the first active pulse signal for driving the far-end sub-pixel unit) may be longer than that of the near-end first active pulse signal (that is, the first active pulse signal for driving the near-end sub-pixel unit), depending on the specific situations.

Based on the foregoing, the display driving method of the embodiment can send a command to the source driver through the timing controller, and the source driver receives the command to control the output position of the data signal. The specific design may be the control signal setting between groups is completely independent. It should be understood that the group mentioned herein includes a plurality of rows of sub-pixel units, the number of rows of sub-pixel units in each group can be 15 to 1000. The number of rows is adjustable, and can be specifically designed with MCU (Micro Control Unit). In the embodiment, by transferring the data output control signal TP, the output position of the data signal Data1 is controlled, so that the far-end sub-pixel unit may obtain more charging time.

For the aforementioned display driving method, an embodiment of the present disclosure further provides a display driving circuit, which can use the display driving method described in any of the foregoing embodiments to drive a display panel. Therefore, the beneficial effects of the display driving circuit of the embodiment are the same as those of the display driving method of any of the foregoing embodiments, and the beneficial effects produced by the display driving circuit will not be described in detail herein.

Figure 7:
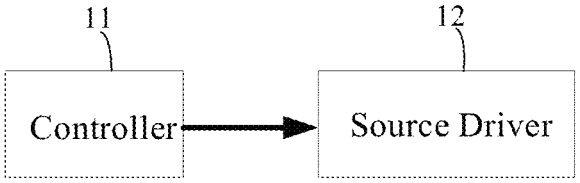
FIG. 7 shows a block diagram of a display driving circuit according to an embodiment of the present disclosure.

In the embodiment, as shown in FIG. 7, the display driving circuit may include a controller 11 and a source driver communicatively connected to the controller 11. The controller 11 is for controlling the source driver to output a data signal, wherein the data signal may include a plurality of first active pulse signals, the first active pulse signal in the Nth row is for driving a sub-pixel unit in the Nth row, and a timing difference t1 between a starting point of the first active pulse signal in the Nth row and a starting point of a corresponding gate drive signal $Gate_N$ is smaller than a timing difference t2 between a starting point of the first active pulse signal in the (N+M)th row and a starting point of a corresponding gate drive signal $Gate_{N+M}$.

The sub-pixel unit in the Nth row is closer to the source driver than the sub-pixel unit in the (N+M)th row, and N and M are positive integers greater than or equal to 1.

Optionally, the controller 11 is a timing controller for controlling the source driver to output the data signal. Specifically, the following two solutions may be included.

The first solution: the timing controller is for outputting a data output control signal to the source driver, and the source driver is controlled to output the data signal based on the data output control signal.

The second solution: the timing controller is for outputting a control signal to the source driver; the source driver is controlled to generate a data output control signal according to the control signal; and the source driver is controlled to output the data signal based on the data output control signal.

The data output control signal in any of the solutions includes a plurality of second active pulse signals, and each of the first active pulse signals corresponds to one second active pulse signal.

In an alternative embodiment, the first active pulse signal is started to be output at the starting point of the second active pulse signal, wherein a timing difference between a starting point of the second active pulse signal in the Nth row and the starting point of the corresponding gate drive signal is smaller than a timing difference between a starting point of the second active pulse signal in the (N+M)th row and the starting point of the corresponding gate drive signal.

In another alternative embodiment, the first active pulse signal is started to be output at the end point of the second active pulse signal, wherein a timing difference between an end point of the second active pulse signal in the Nth row and the starting point of the corresponding gate drive signal is smaller than a timing difference between an end point of the second active pulse signal in the (N+M)th row and the starting point of the corresponding gate drive signal.

Figure 8:
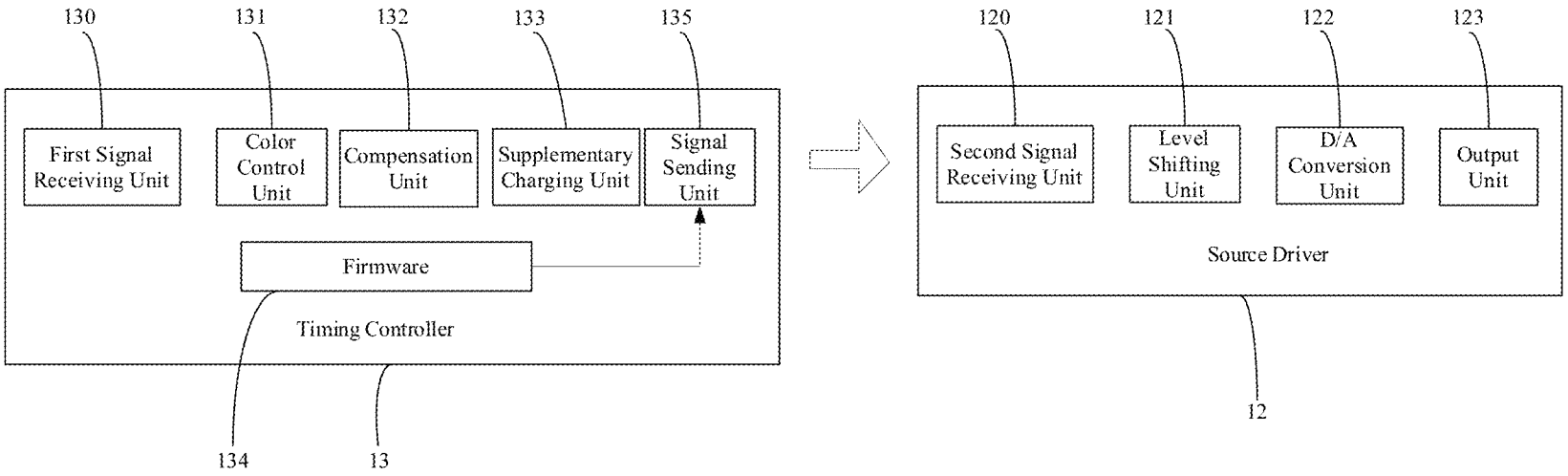
FIG. 8 shows a block diagram of a display driving circuit according to another embodiment of the present disclosure.

As shown in FIG. 8, the timing controller 13 may include a first signal receiving unit (first Rx unit) 130, a color control unit (ACC unit) 131, a compensation unit (OD unit) 132, and a supplementary charging unit (VCC unit) 133, a firmware unit (FW unit) 134 and a signal sending unit (Tx unit) 135; and the source driver 12 may include a second signal receiving unit (second Rx unit) 120, a level shifting unit (LS unit) 121, a digital-to-analog conversion unit (DAC unit) 122 and an output unit (OP unit) 123, wherein the Tx unit 135 in the timing controller 13 sends a signal to the second Rx unit 120 of the source driver 12, and the signal received by the second Rx unit 120 may be processed by other units of the source driver 12 (for example, the LS unit 121, the DAC unit 122, and the like) to be converted into the data signal, which can be output through the OP unit 123.

It should be understood that the respective units in the timing controller 13 and the respective units in the source driver 12 mentioned in the embodiment have conventional structures, and have the same function as the conventional units. The structures of these units are not the main improvement points of the disclosure; therefore, they will not be described in detail.

Figure 9:
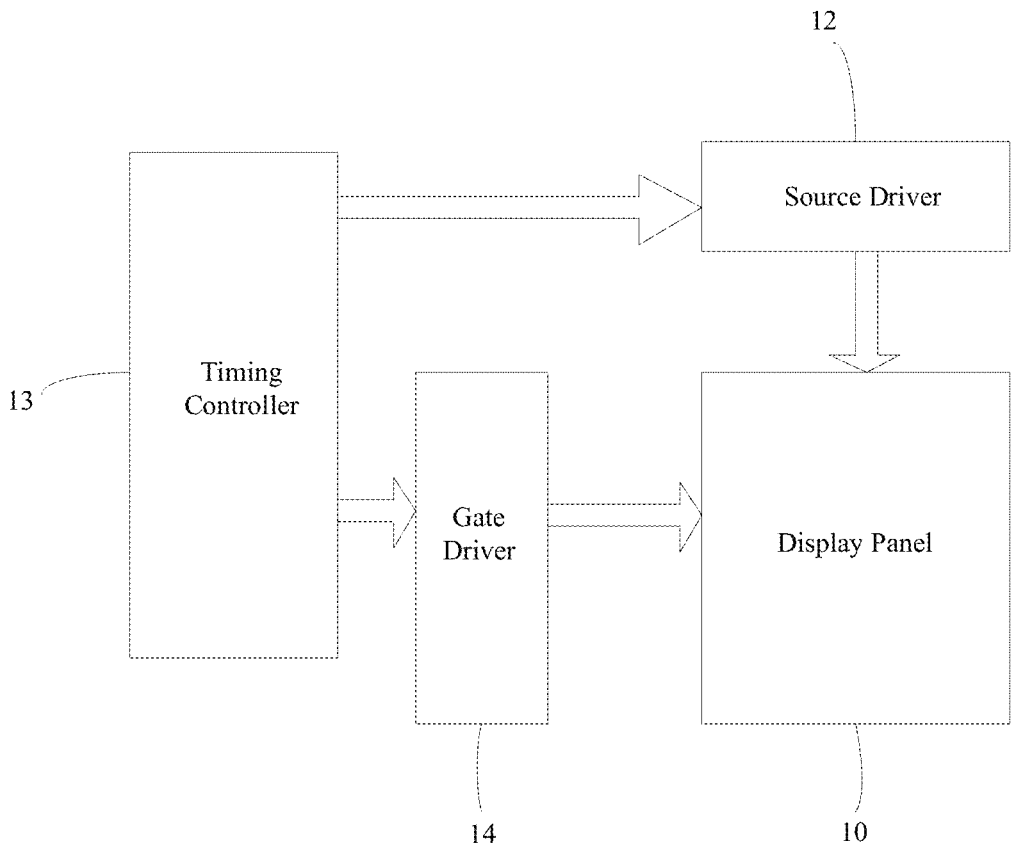
FIG. 9 shows a block diagram of a display device according to an embodiment of the present disclosure.

In addition, it should be noted that, as shown in FIG. 9, the display driving circuit may include not only the aforementioned timing controller 13 and source driver 12, but also a gate driver 14, which may be communicatively connected to the timing controller 13, and the timing controller 13 may control the gate driver 14 to send the aforementioned gate signal.

An embodiment of the present disclosure further provides a display device, which includes a display panel and the display driving circuit described in any of the foregoing embodiments. As shown in FIG. 9, the display driving circuit may include the timing controller 13, the source driver 12 and the gate driver 14. The display driving circuit is used to drive the display panel. The display panel may be a liquid crystal display panel, but it is not limited thereto. According to the embodiment of the present disclosure, the specific type of the display device is not particularly limited, and any type of display device commonly used in the art may be used, such as a liquid crystal display or a mobile device with a liquid crystal display, a wearable device, a VR device, and the like. A person skilled in the art may make a corresponding selection according to the specific use of the display device, which will not be repeated herein.

The terms "a", "an", "the", and "said" are used to indicate the presence of one or more elements/components/etc.; the terms "comprising" and "including" are used to indicate open-ended inclusive means, and means that there may be additional elements/components/etc., in addition to the listed elements/components/etc.; and the terms "first" and "second" are only used as markers, not to limit the number of objects.

Those skilled in the art will readily contemplate other embodiments of the present disclosure after considering the specification and practicing the invention disclosed herein. This disclosure is intended to cover any variations, uses, or adaptations of the present disclosure that conform to the general principles of the disclosure and include the common general knowledge or conventional technical means in the technical field not disclosed by the disclosure. It is intended that the specification and examples be considered as exemplary only, with a true scope and spirit of the disclosure being indicated by the appended claims.

What is claimed is:

1. A display driving method, comprising:

controlling a source driver to output a data signal, wherein the data signal comprises a plurality of first active pulse signals and a timing difference between a starting point of the first active pulse signal in a Nth row and a starting point of a gate drive signal corresponding to a sub-pixel unit in the Nth row is smaller than a timing difference between a starting point of the first active pulse signal in a (N+M)th row and a starting point of a gate drive signal corresponding to a sub-pixel unit in the (N+M)th row;

wherein the first active pulse signal in the Nth row is used for driving the sub-pixel unit in the Nth row, and the first active pulse signal in the (N+M)th row is used for driving the sub-pixel unit in the (N+M)th row; and wherein the sub-pixel unit in the Nth row is closer to the source driver than the sub-pixel unit in the (N+M)th row, and N and M are positive integers greater than or equal to 1, wherein controlling the source driver to output the data signal further comprises:

outputting a data output control signal to the source driver by using a timing controller; and controlling the source driver to output the data signal based on the data output control signal, wherein the data output control signal comprises a plurality of second active pulse signals, and each of the first active pulse signals corresponds to one of the second active pulse signals; or outputting a control signal to the source driver by using a timing controller;

controlling the source driver to generate a data output control signal according to the control signal; and controlling the source driver to output the data signal based on the data output control signal, wherein the data output control signal comprises a plurality of second active pulse signals, and each of the first active pulse signals corresponds to one of the second active pulse signals.

2. The display driving method according to claim 1, wherein:

the first active pulse signal is started to be output at a starting point of the second active pulse signal; and a timing difference between a starting point of the second active pulse signal in the Nth row and a starting point of the gate drive signal corresponding to the sub-pixel unit in the Nth row is smaller than a timing difference between a starting point of the second active pulse signal in the (N+M)th row and the starting point of the gate drive signal corresponding to the sub-pixel unit in the (N+M)th row.

3. The display driving method according to claim 1, wherein:

the first active pulse signal is started to be output at an end point of the second active pulse signal; and a timing difference between an end point of the second active pulse signal in the Nth row and the starting point of the gate drive signal corresponding to the sub-pixel unit in the Nth row is smaller than a timing difference between an end point of the second active pulse signal in the (N+M)th row and the starting point of the gate drive signal corresponding to the sub-pixel unit in the (N+M)th row.

4. The display driving method according to claim 1, wherein M is larger than 1, and a timing difference between a starting point of the first active pulse signal in each row of the Nth row, a (N+1)th row, . . . , and a (N+M−1)th row and a starting point of a gate drive signal corresponding to each row, respectively, is the same.

5. The display driving method according to claim 1, wherein the timing difference is 0 to 0.5 μs.

6. The display driving method according to claim 1, wherein a timing difference between an end point of the first active pulse signal of each row and an end point of the gate drive signal corresponding to each row, respectively, is greater than or equal to zero.

7. A display driving circuit, comprising:

a controller and a source driver communicatively connected to the controller, wherein:

the controller is configured to control the source driver to output a data signal;

the data signal comprises a plurality of first active pulse signals;

a timing difference between a starting point of the first active pulse signal in a Nth row and a starting point of a gate drive signal corresponding to a sub-pixel unit in the Nth row is smaller than a timing difference between a starting point of the first active pulse signal in a (N+M)th row and a starting point of a gate drive signal corresponding to a sub-pixel unit in the (N+M)th row;

the first active pulse signal in the Nth row is used for driving the sub-pixel unit in the Nth row, and the first active pulse signal in the (N+M)th row is used for driving the sub-pixel unit in the (N+M)th row; and the sub-pixel unit in the Nth row is closer to the source driver than the sub-pixel unit in the (N+M)th row, and N and M are positive integers greater than or equal to 1, wherein:

the controller is a timing controller configured to output a data output control signal to the source driver; the source driver is controlled to output the data signal based on the data output control signal; the data output control signal comprises a plurality of second active pulse signals, and each of the first active pulse signals corresponds to one of the second active pulse signals, or the controller is a timing controller configured to output a control signal to the source driver; the source driver is controlled to generate a data output control signal according to the control signal and output the data signal based on the data output control signal; the data output control signal comprises a plurality of second active pulse signals, and each of the first active pulse signals corresponds to one of the second active pulse signals.

8. The display driving circuit according to claim 7, wherein:

the first active pulse signal is started to be output at a starting point of the second active pulse signal; and a timing difference between a starting point of the second active pulse signal in the Nth row and a starting point of the gate drive signal corresponding to the sub-pixel unit in the Nth row is smaller than a timing difference between a starting point of the second active pulse signal in the (N+M)th row and a starting point of the gate drive signal corresponding to the sub-pixel unit in the (N+M)th row.

9. The display driving circuit according to claim 7, wherein:

the first active pulse signal is started to be output at an end point of the second active pulse signal; and a timing difference between an end point of the second active pulse signal in the Nth row and the starting point of the gate drive signal corresponding to the sub-pixel unit in the Nth row is smaller than a timing difference between an end point of the second active pulse signal in the (N+M)th row and the starting point of the gate drive signal corresponding to the sub-pixel unit in the (N+M)th row.

10. The display driving circuit according to claim 7, wherein M is larger than 1, and a timing difference between a starting point of the first active pulse signal in each row of the Nth row, a (N+1)th row, . . . , and a (N+M−1)th row and a starting point of a gate drive signal corresponding to the each row, respectively, is the same.

11. A display device, comprising:

a display panel and a display driving circuit, the display driving circuit being configured to drive the display panel and comprising a controller and a source driver communicatively connected to the controller, wherein:

the controller is configured to control the source driver to output a data signal;

the data signal comprises a plurality of first active pulse signals;

the first active pulse signal in a Nth row is used for driving a sub-pixel unit in a Nth row;

a timing difference between a starting point of the first active pulse signal in the Nth row and a starting point of a gate drive signal corresponding to the sub-pixel unit in the Nth row is smaller than a timing difference between a starting point of the first active pulse signal in a (N+M)th row and a starting point of a gate drive signal corresponding to a sub-pixel unit in the (N+M)th row;

the sub-pixel unit in the Nth row is closer to the source driver than the sub-pixel unit in the (N+M)th row; and N and M are positive integers greater than or equal to 1, wherein:

the controller is a timing controller configured to output a data output control signal to the source driver; the source driver is controlled to output the data signal based on the data output control signal; the data output control signal comprises a plurality of second active pulse signals; and each of the first active pulse signals corresponds to one of the second active pulse signals, or the controller is a timing controller configured to output a control signal to the source driver; the source driver is controlled to generate a data output control signal according to the control signal and output the data signal based on the data output control signal; the data output control signal comprises a plurality of second active pulse signals; and each of the first active pulse signals corresponds to one of the second active pulse signals.

12. The display device according to claim 11, wherein:

the first active pulse signal is started to be output at a starting point of the second active pulse signal; and a timing difference between a starting point of the second active pulse signal in the Nth row and a starting point of the gate drive signal corresponding to the sub-pixel unit in the Nth row is smaller than a timing difference between a starting point of the second active pulse signal in the (N+M)th row and a starting point of the gate drive signal corresponding to the sub-pixel unit in the (N+M)th row.

13. The display device according to claim 11, wherein:

the first active pulse signal is started to be output at an end point of the second active pulse signal; and a timing difference between an end point of the second active pulse signal in the Nth row and the starting point of the gate drive signal corresponding to the sub-pixel unit in the Nth row is smaller than a timing difference between an end point of the second active pulse signal in the (N+M)th row and the starting point of the gate drive signal corresponding to the sub-pixel unit in the (N+M)th row.

14. The display device according to claim 11, wherein M is larger than 1, and a timing difference between a starting point of the first active pulse signal in each row of the Nth row, a (N+1)th row, . . . , and a (N+M−1)th row and a starting point of a gate drive signal corresponding to the each row, respectively, is the same.

* * * * *